US006684475B2

(12) United States Patent
Geissler et al.

(10) Patent No.: US 6,684,475 B2
(45) Date of Patent: Feb. 3, 2004

(54) METHOD OF MAKING LARGE VOLUME HOLLOW BODIES

(75) Inventors: Stefan Geissler, Nordkirchen (DE); Karl Norbert Lohmann, Balve (DE); Theodor Ostermann, Menden (DE); Matthias Adolph, Menden (DE)

(73) Assignee: HDE Solutions GmbH, Menden (DE)

( * ) Notice: Subject to any disclaimer, the term of this patent is extended or adjusted under 35 U.S.C. 154(b) by 0 days.

(21) Appl. No.: 09/817,749

(22) Filed: Mar. 26, 2001

(65) Prior Publication Data

US 2002/0029456 A1 Mar. 14, 2002

(30) Foreign Application Priority Data

Mar. 31, 2000 (DE) ..... 100 16 025

(51) Int. Cl.[7] ..... B23P 17/00

(52) U.S. Cl. ..... 29/421.1; 72/54; 72/57; 72/58; 72/60; 72/61; 228/101

(58) Field of Search ..... 29/421.1, 421.2, 29/512; 72/54, 57, 60, 61, 62, 58; 228/144, 101, 155; 220/4.12, 4.14, 612, 660

(56) References Cited

U.S. PATENT DOCUMENTS

| | | | | |
|---|---|---|---|---|
| 2,503,190 A | | 4/1950 | Branson | |
| 3,572,073 A | * | 3/1971 | Narberth et al. | 72/62 |
| 4,157,609 A | * | 6/1979 | Schutz | 29/428 |
| 4,175,227 A | * | 11/1979 | Kasper | 219/125.12 |
| 5,841,090 A | * | 11/1998 | Taiana | 219/64 |
| 6,216,509 B1 | * | 4/2001 | Lotspaih et al. | 72/61 |
| 6,341,515 B2 | * | 1/2002 | Huber et al. | 72/60 |
| 6,415,638 B1 | * | 7/2002 | Sakurai et al. | 72/57 |

FOREIGN PATENT DOCUMENTS

| | | |
|---|---|---|
| BE | 474713 | 7/1947 |
| DE | 2 159 852 | 8/1972 |
| DE | 0 372 360 | 6/1990 |
| DE | 44 36 436 | 8/1996 |
| DE | 197 19 531 | 11/1998 |
| DE | 198 51 259 | 5/2000 |
| FR | 2228551 | 12/1974 |
| GB | 2334472 | 8/1999 |
| JP | 51 083062 | 7/1976 |
| JP | 53 096963 | 8/1978 |
| WO | WO 00/10748 | 2/2000 |

* cited by examiner

*Primary Examiner*—Gregory Vidovich
*Assistant Examiner*—Essama Omgba
(74) *Attorney, Agent, or Firm*—Herbert Dubno

(57) ABSTRACT

A large dimension hollow body such as a fuel tank is formed from cold deformable sheet metal by cutting a sheet metal blank of a conformation matching the hollow structure to be formed and which has a nonuniform cross section between its ends. The sheet metal blank is then formed into a three-dimensional shape closed at one end and subjected to hydrostatic forming, whereupon the other end is closed optionally after insertion of an object to be received in the tank such as a fuel pump. The welding of the edges of the blank together and the application of the caps can produce pressure-tight weld seams and can be effected by laser-beam welding or tungsten inert gas welding.

6 Claims, 10 Drawing Sheets

METHOD OF MAKING LARGE VOLUME HOLLOW BODIES

FIELD OF THE INVENTION

Our present invention relates to a method of making large-volume-hollow bodies at least in part by hydrostatic deformation of a cold-formable metal. More particularly, the invention relates to the fabrication of bodies by hydrostatic shaping, especially for containers such as the fuel tanks of motor vehicles.

BACKGROUND OF THE INVENTION

The reference to large-volume hollow bodies herein is understood to refer to hollow bodies which may have a capacity of 10 liters or more and can be used, for example, for fuel tanks for automotive vehicles.

In DE 44 36 436, a method of hydrostatic shaping of cold-formable sheet metal is described in which two planar sheets of the metal are fabricated by hydroforming into two matching halves of the large volume body and are then welded together along their equator line and peripherally to produce the hollow body.

This method has the drawback that, because of the need to accommodate after-flow of the metal in the forming of a circumferential flange and the removal thereof and machining in conjunction with the weld seam which is intended to seal the halves together, the cost of the material for the container and the time-consuming process militate against use of the method in mass production.

When efforts have been made to use the earlier method in a mass production sense, because of the peripheral welding, problems have been encountered in reproducibility and reliability of the process.

A process is described in DE 197 19 531 in which a metal blank is welded together after an initial shaping and is then hydraulically deformed to a more or less square or cubic shape. The method described in that publication, however, was found to be applicable only to the formation of bodies of relatively constant cross section which can be fabricated in a single expansion process.

Mention may also be made, in this connection, of EP 0 372 360, DE OS 21 59 852, DE OS 198 51 259 A1 which relate to systems in which hollow structures are formed using weld arrangements and entraining shaping pressure.

OBJECTS OF THE INVENTION

It is the principal object of the present invention to provide an improved method of making hollow bodies, especially large hollow bodies as defined, such as motor vehicle fuel tanks, which is applicable even where the hollow body is not of a constant cross section and whereby drawbacks of earlier systems are avoided.

Another object of this invention is to provide a highly economical, reliable and reproducible process for producing hollow bodies, especially for motor vehicle fuel tanks, which obviates drawbacks of the method hitherto mentioned.

SUMMARY OF THE INVENTION

These objects are attained, in accordance with the invention, by a method of making a large volume hollow body which comprises the step of:

(a) cutting a blank from a cold-deformable sheet metal having a shape matched to a configuration of the hollow body and a pair of opposite edges between ends of the blank;

(b) shaping the blank generally into the configuration of the hollow body to form a three-dimensional structure smaller than the hollow body, welding the opposite edges together to form a pressure-tight seam along the three-dimensional structure, and closing one end of the three-dimensional structure;

(c) inserting the three-dimensional structure formed in step (b) in a die and expanding the three-dimensional structure in the die to the configuration of the hollow body by hydrostatic shaping through an opposite end of the three-dimensional structure, thereby imparting to the three-dimensional structure a configuration of the die; and (d) welding to the three-dimensional structure expanded in step (c) at the opposite end thereof a closure to form the structure into the hollow body.

According to a feature of the invention the one end of the three-dimensional structure is closed in step (b) by welding a closure member to the three-dimensional structure with a pressure-tight welding seam.

Prior to hydrostatic expansion of the three-dimensional structure, the latter can be pressed into a flattened oval configuration.

The method of the invention has a number of advantages. The most important advantage is that it fabricates the three-dimensional structure and ultimately the hollow body from a blank which has previously been imparted a shape matched to the configuration of the hollow body and the pressure-tight weld seam which can secure the three-dimensional shape without stress and overlap at the weld seam so that there is little waste of material and the pressure tightness of the weld seam can be reliably and reproducibly made even in a mass-produced product. The hollow body can have a large diameter cross section at one end and a small-diameter cross section at the other end and need not have the same end cross sections. Conical and partially conical and partially cylindrical structures can be fabricated and hydrostatically widened.

The fact that the three-dimensional structure is already of a shape geometrically similar to that of the hollow body which is to be made means that the hydrostatic expansion can be effected in a single step and thus expensive annealing between shaping steps is not required. The closed end may be sealed shut by a closure member welded with a pressure-tight weld seam to the three-dimensional structure even before the expansion of that three-dimensional or tubular structure.

The invention can avoid the need for expensive sealing as is thus required when two openings are provided in the three-dimensional structure before the hydrostatic expansion step. A less expensive die can thus be used than would otherwise be required.

The flattened oval configuration which is imparted to the structure can facilitate insertion of the three-dimensional structure into the die and closing of the die. Frequently when the three-dimensional or tubular structure is not flattened, difficulties are experienced in insertion of the tubular structure into the die or in the closing of the die.

When the three-dimensional structure is filled with the pressure fluid and then pressed into its flattened oval configuration, the formation of folds or the like in the sheet metal material can be avoided.

It has been found to be advantageous, moreover, to include in the three-dimensional structure following the expansion and prior to welding of the closure thereon, to incorporate one or more objects in the three-dimensional structure and thus in the hollow body. Preassembled use such as fuel pumps and the like can be included in this way. The hollow body can be formed during the hydrostatic expansion with an opening for filling or emptying the tank made and it is advantageous to provide the tank with a collar surrounding the opening during the hydrostatic expansion. Before the hydrostatic expansion, a liquid displacement element can be inserted into the three-dimensional structure thereby reducing the time for filling it with the hydrostatic liquid or emptying the hydrostatic liquid from it. The displacement element can be mounted for example on an adapter which fits into the open end of the three-dimensional structure.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
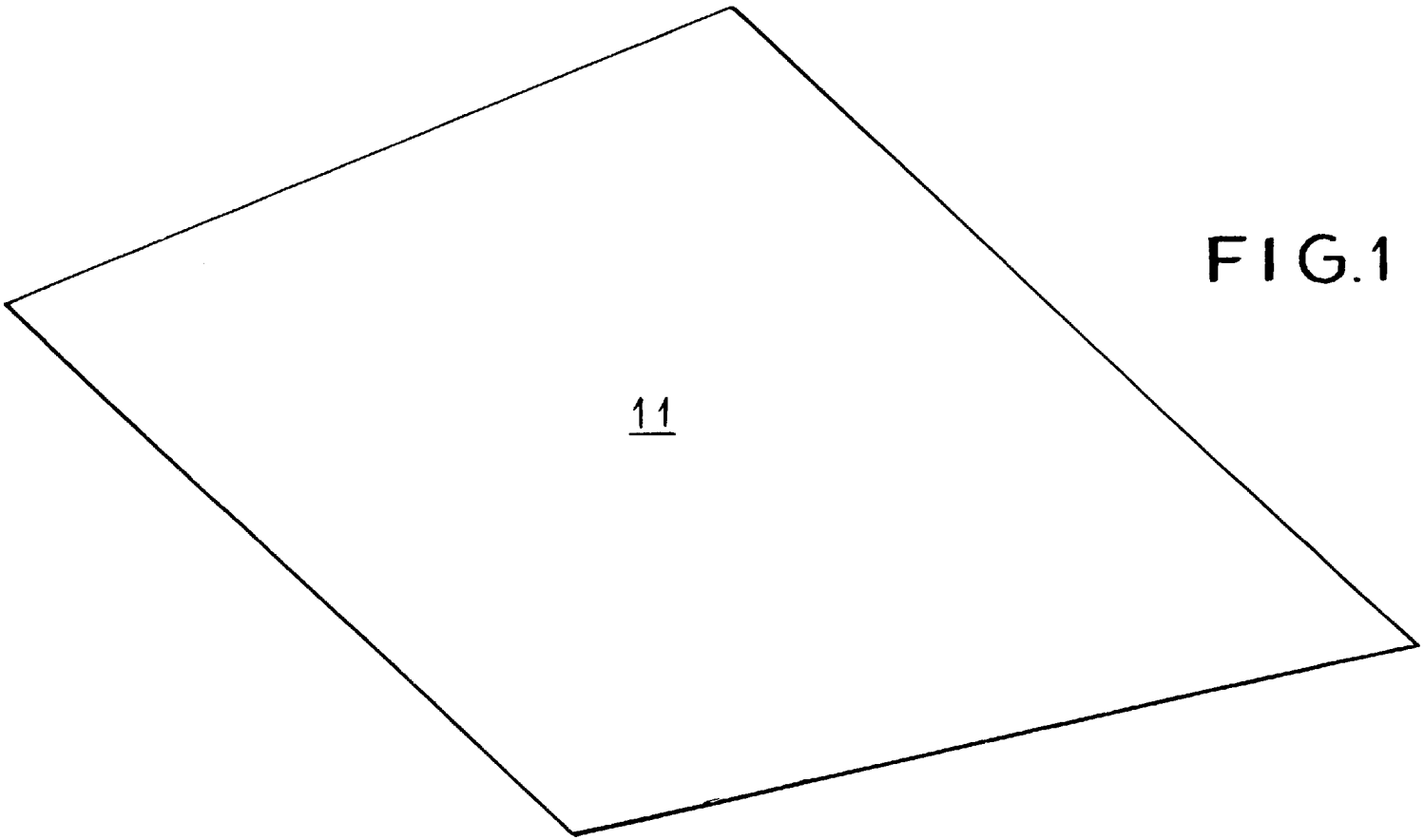
FIG. 1 is an elevational view of a flat blank which has been cut from a cold-deformable sheet metal to a shape matched to conformation of a frustoconical hollow body.

In the drawing the large volume hollow body as a whole has been indicated by the reference character 10. As can be seen from FIGS. 9 and 10, for example, that hollow body 10 can be somewhat tapered from a large diameter end to a smaller diameter end and can be generally a frustoconical configuration. It may be provided with inwardly-extending ribs 10*a* and 10*b* formed by pressing the body of the material outwardly in regions 10*c*, 10*d* and 10*e* on opposite sides of these ribs. The fuel tank can be formed with a hole shown only in dot dash lines at 10*f* surrounded by an outwardly-projecting collar 10*g* which subsequent to the hydrostatic pressing and to which the other tubular fitting for filling the tank may be welded.

Figure 2:
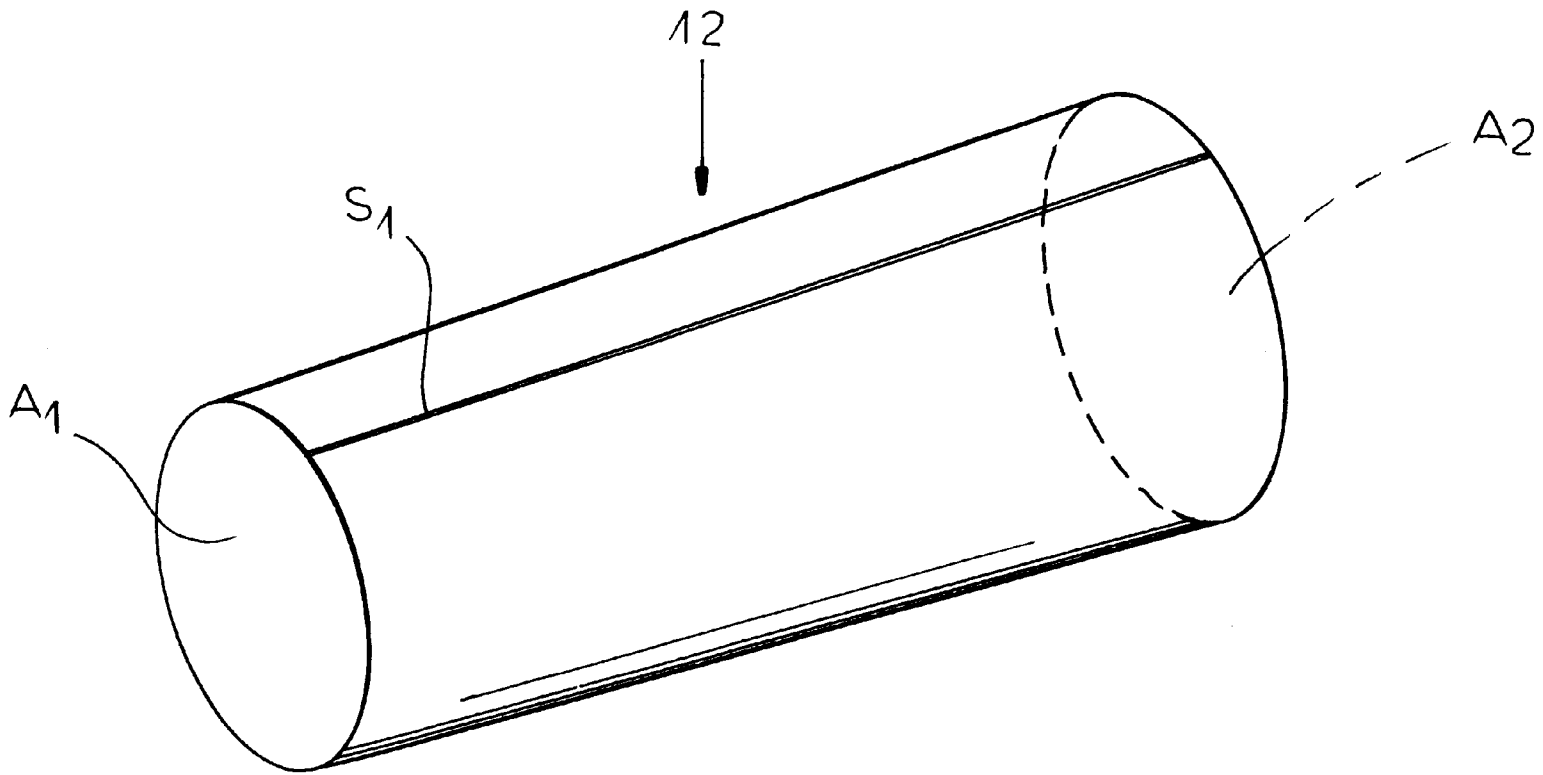
FIG. 2 is a perspective view in diagrammatic form illustrating the tubular body or three-dimensional structure formed from that blank by welding the opposite edges thereof together.

The hollow body 10 is fabricated from a cold working sheet blank 11 (FIG. 1) whose edges have been trimmed to converge so that this blank conforms to the developed configuration of the hollow body 10 prior to expansion and when rolled, yields a tubular body 12 (FIG. 2) with two open ends $A_1$ and $A_2$. The opposite edges of the body which converge in the blank are welded together to form a butt weld seam by tungsten inert gas welding. The laser beam welding can also be used to form the pressure-tight weld seam shown at $S_1$ in FIG. 2.

The tubular body 2 which corresponds to the three-dimensional structure mentioned previously can also be partly cylindrical or can have cylindrical portions.

The important point is that at the two ends of the body 12 cylindrical segments can be provided or the segments can define circular portions into which a cap 13 can be introduced, e.g. at the smaller end $A_1$. The end 13 is welded in place with a pressure-tight weld seam $S_2$. The blank 11, the body 12 and the cap 13, including its welds are composed of cold deformable material so that they can be expanded in a single step by hydrostatic deformation without undergoing cold hardening and requiring an expensive annealing or tempering operation.

Figure 3:
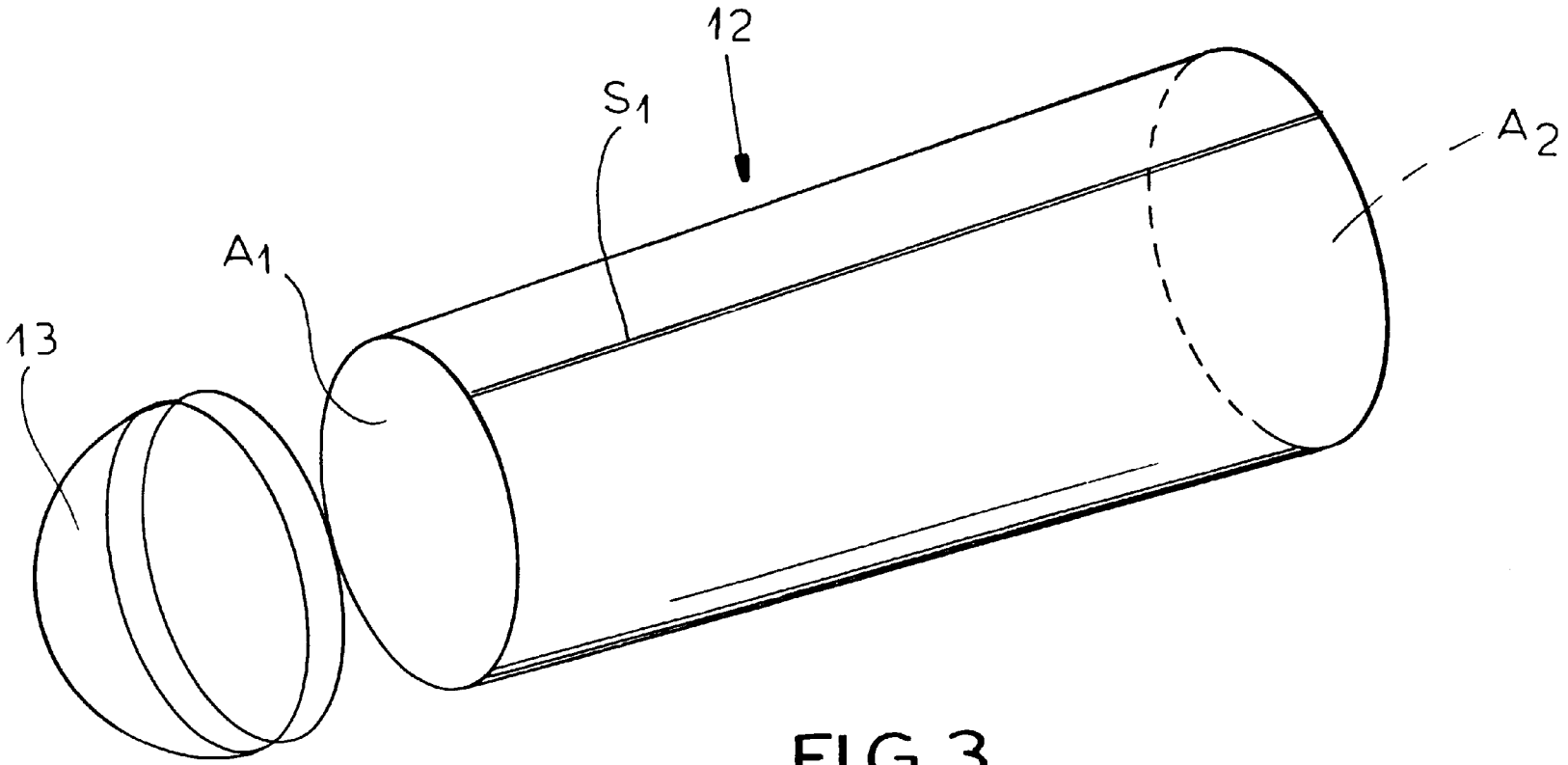
FIG. 3 is a diagram showing the application of a cap as a closure to one end of that structure in a perspective view.
Figure 4:
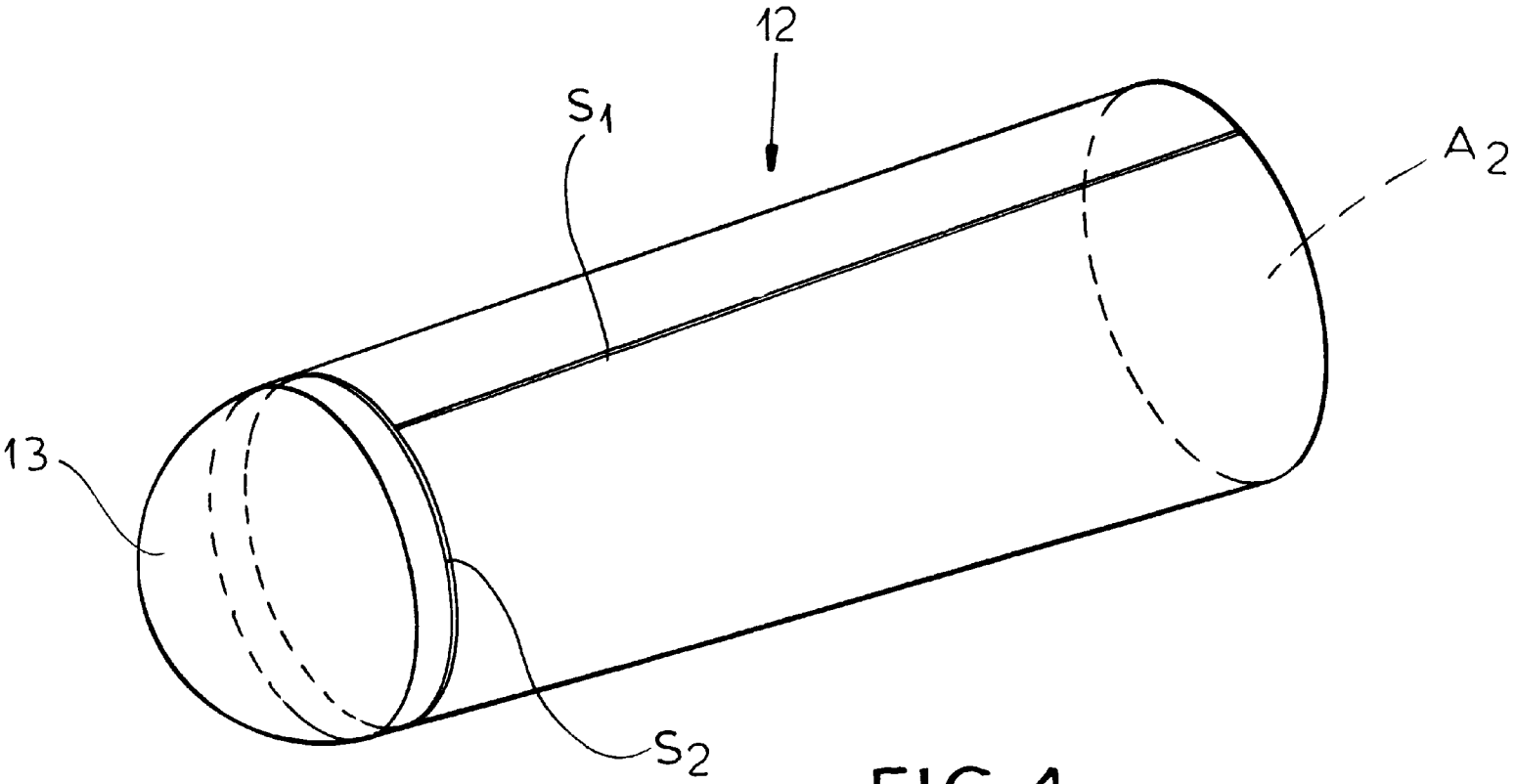
FIG. 4 is a perspective view showing the three-dimensional structure with its end closed by the cap.

FIGS. 3 and 4 also show that the cap 13 can have been made by a hydroforming process or by deep drawing.

Figure 5:
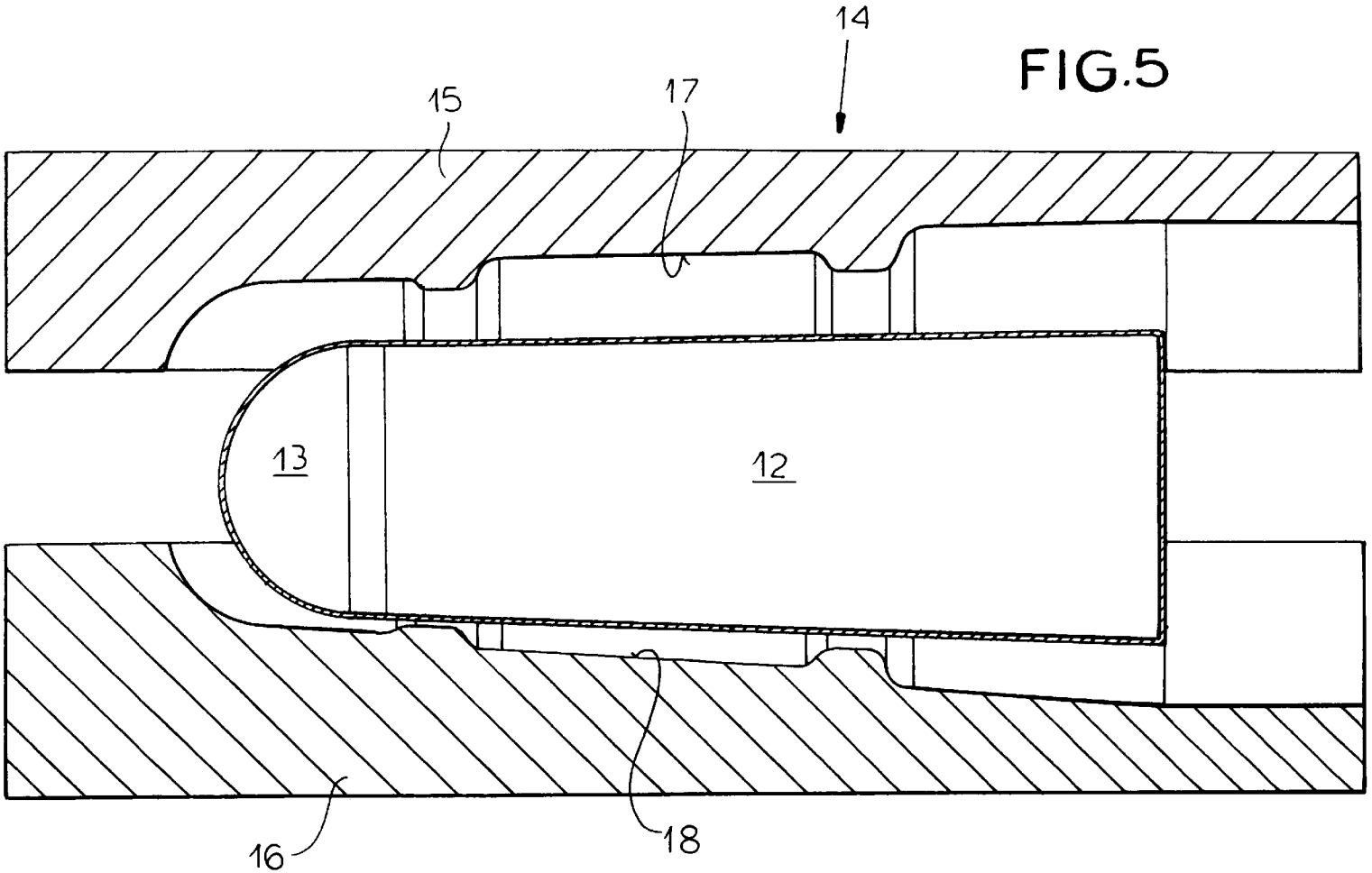
FIG. 5 is a cross sectional view through a mold into which the three-dimensional structure has been inserted.
Figure 6:
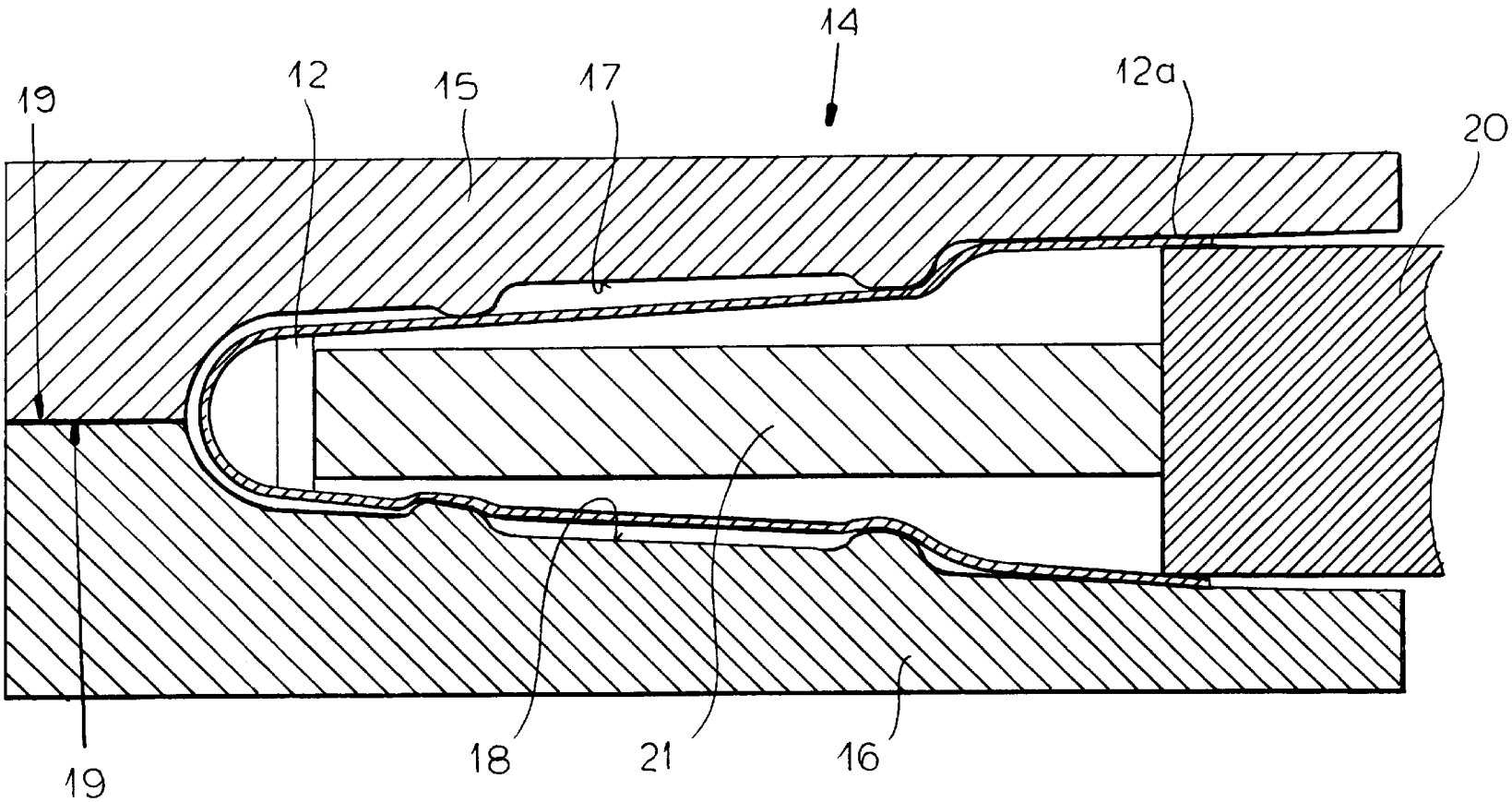
FIG. 6 is a cross sectional view of the mold during the initial stages of hydrostatic deformation and illustrating use of a displacement body on an adapter.

The opposite end of the three-dimensional structure at $A_2$ can be closed by a cap designed to fit an adapter directly. The three-dimensional structure of FIG. 4 is then inserted into a die 14 having die halves 15 and 16 and provided with contours 17, 18 which define the final shape of the body 10. The die is then closed on the three-dimensional body 12 (compare FIGS. 5 and 6), a process which imparts a flattened oval shape to the body 12.

Figure 7:
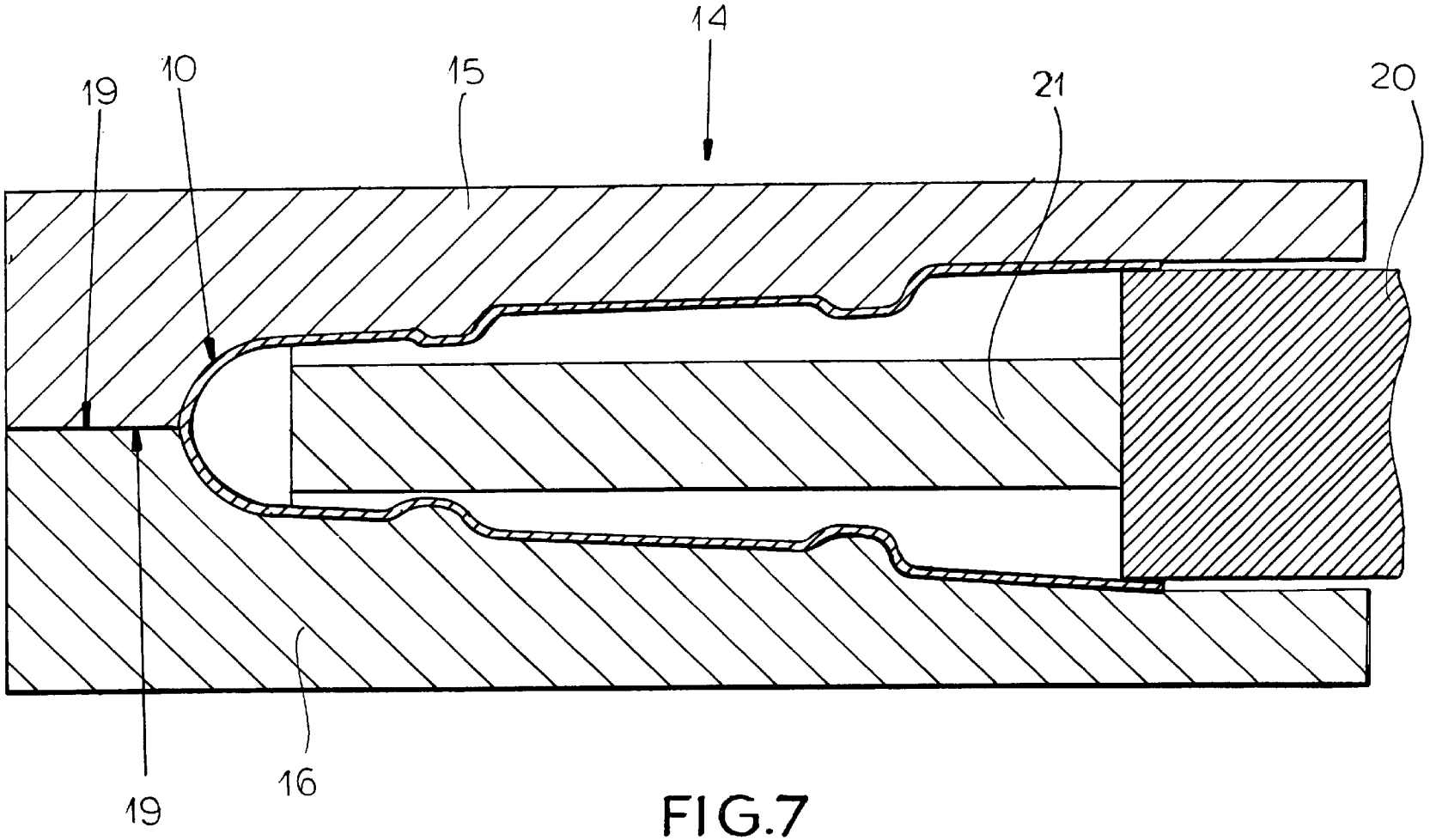
FIG. 7 is a cross sectional view following the hydrostatic deformation.
Figure 9:
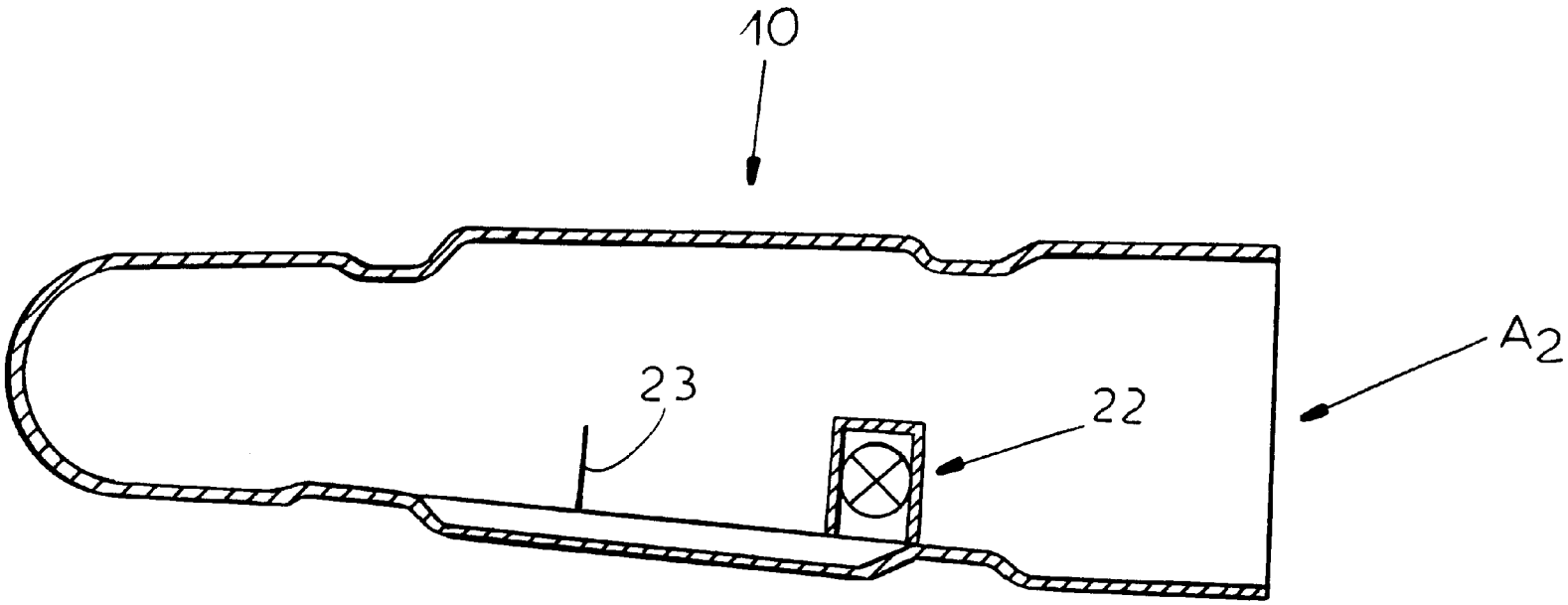
FIG. 9 is a cross sectional view showing the presence of an object in the deformed body.
Figure 10:
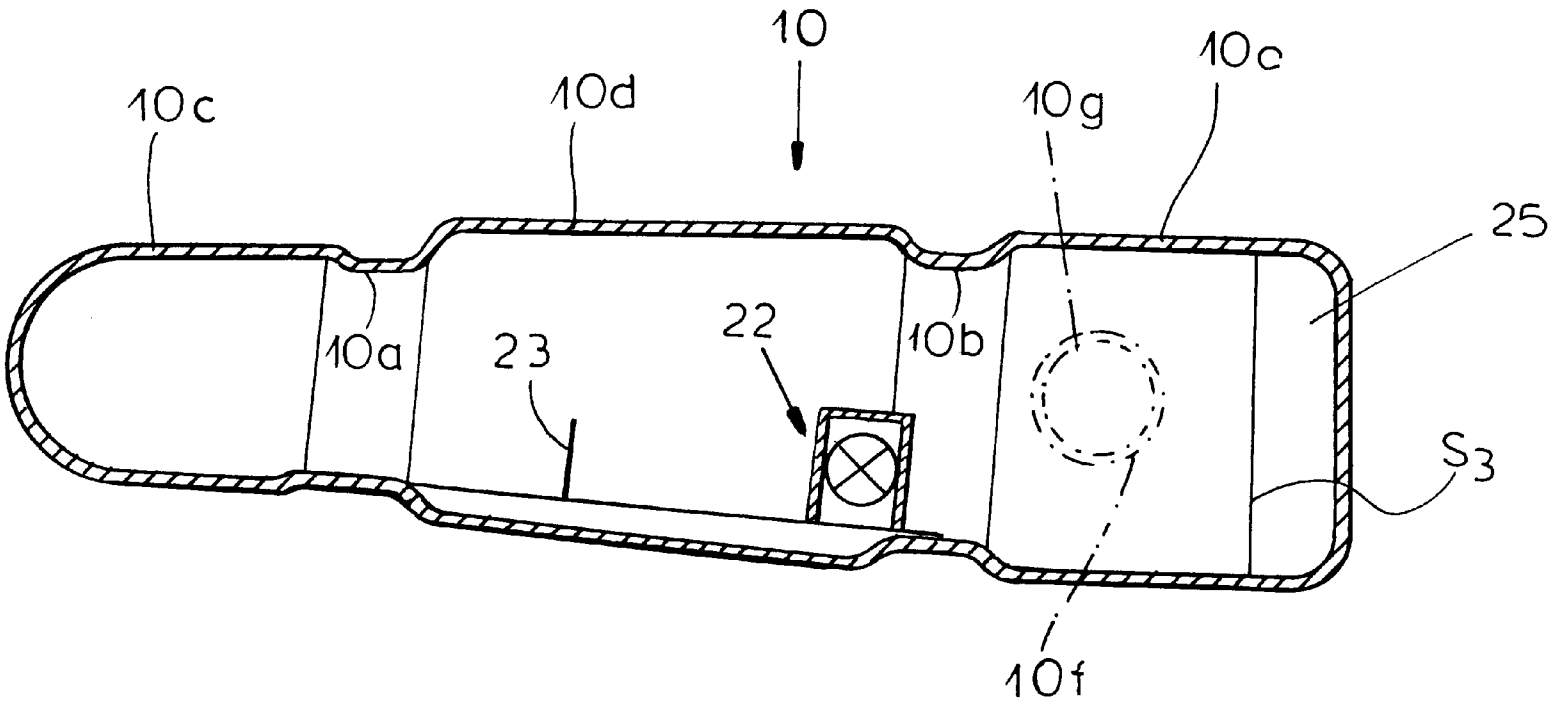
FIG. 10 is a cross sectional view showing the hollow body after the closure of the other end.

The faces of the die welded together at 19 and the die presses the mouth 12*a* at the open end of the structure 12 against an adapter 20 which has been inserted into the body 12 and carries a displacement body 21 serving to reduce the volume of the liquid which must be hydrostatically pressurized in the tube 12 to effect the displacement. The tube 12 is then filled with the pressurizable liquid and the upper and lower parts of the die 15 and 16 are placed under pressure. The hydrostatic pressure is built up through passages within the adapter 20 and the displacement body 21 to deform the structure 12 at say about 1000 bar to force the sheet metal against the patterns 17 and 18 constituted by the internal surfaces of the die (see FIG. 7). After the plastic deformation of the sheet metal in this fashion and removal of the adapter 20 and the deformed structure from the die, the product is cleaned and dried and through the opening $A_2$, inserts can be provided which are intended to be present in the finished fuel tank such as the pump 22 and a baffle 23 serving to prevent sloshing and acting as a wave breaker (FIG. 9).

Figure 8:
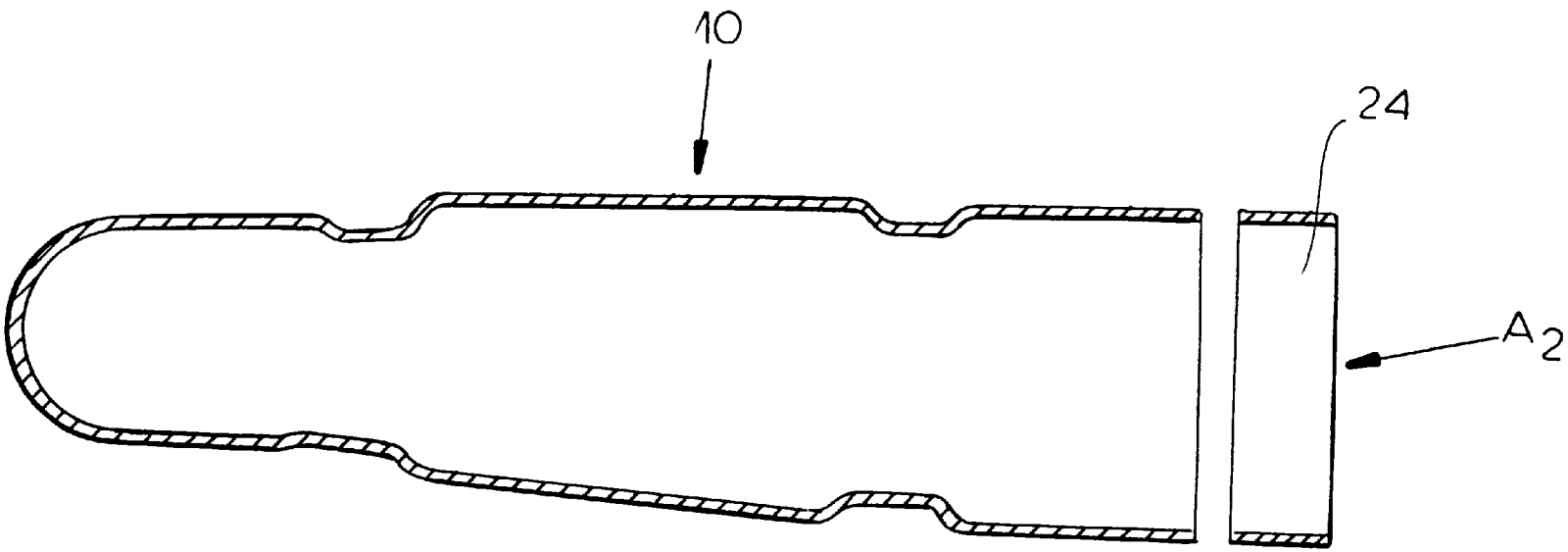
FIG. 8 is a cross sectional view through the hollow body after removal of the sealing end.

The mouth which was deformed around the adapter can then be cut off as shown at 24 in FIG. 8 to accommodate another cap 25 capable of closing the end of the bank and which can, if desired, be provided with a filling port and fitting.

The segment 24 can also be cut off before the tank has been provided with its internal objects.

The weld seam $S_3$, fabricated in the manner described, closes the tank.

We claim:

1. A method of making a hollow body having different end configurations comprising thin step of:

(a) cutting a blank from a cold-deformable sheet metal having a shape matched to a configuration of said hollow body and a pair of opposite edge between end of said blank;

(b) shaping said blank generally into said configuration of said hollow body to form a three-dimensional structure smaller than the hollow body, butt welding said opposite edges together to form a pressure-tight seam along said three-dimensional structure, and closing one end of said three-dimensional structure by welding an end cap thereto at a pressure-tight seam;

(c) inserting the three-dimensional structure formed in step (b) in a die having an asymmetrical shape and expanding maid three-dimensional structure in said die to said configuration of said hollow body by hydrostatic shaping in a single die-shaping operation through an opposite end of said three-dimensional structure, thereby imparting to said three-dimensional structure a configuration of said die;

(d) welding to the three-dimensional structure expanded in step (c) at the opposite end thereof a closure to form said structure into said hollow body; and (e) forming in said three-dimensional structure during the hydrostatic expansion at least one opening for a fuel tank filling fitting; and (f) deforming from said sheet metal a collar adapted to surround said opening during the hydrostatic expansion thereof, said collar constituting a welding fitting enabling said tank filling fitting to be secured thereto subsequent to hydrostatic expansion.

2. The method defined in claim 1 wherein, prior to hydrostatic expansion of said three-dimensional structure, said three-dimensional structure is pressed into a configuration of a flattened oval.

3. The method defined in claim 2 wherein said three-dimensional structure is filled with a pressure- transmitting liquid prior to pressing said three-dimensional structure into the configuration of the flattened oval.

4. The method defined in claim 1, further comprising the step of incorporating at least one object into said three-dimensional structure prior to the welding of said closure, thereto.

5. The method defined in claim 1, further comprising the step of inserting through said opposite end of said three-dimensional structure a liquid displacement body prior to expansion of said three-dimensional structure.

6. The method defined in claim 1, further comprising trimming a portion from said three-dimensional structure prior to welding of maid closure to said opposite end thereof.

* * * * *